United States Patent [19]

Cohen

[11] 4,057,773

[45] Nov. 8, 1977

[54] MAGNETIC SWITCH

[76] Inventor: Morton Cohen, 41-27 Westmoreland St., Little Neck, N.Y. 11363

[21] Appl. No.: 656,098

[22] Filed: Feb. 9, 1976

[51] Int. Cl.[2] ..... H01H 9/00

[52] U.S. Cl. ..... 335/205; 200/61.76; 340/274 R

[58] Field of Search ..... 200/61.62, 61.74, 61.76, 200/61.93, 67 F, 153 W; 335/205; 340/374

[56] References Cited

U.S. PATENT DOCUMENTS

| | | | |
|---|---|---|---|
| 3,281,735 | 10/1966 | Blumish | 200/67 F |
| 3,539,741 | 11/1970 | Voland | 200/61.62 |
| 3,806,852 | 4/1974 | Suska | 335/205 |

FOREIGN PATENT DOCUMENTS

| | | | |
|---|---|---|---|
| 909,571 | 1/1946 | France | 200/153 W |

*Primary Examiner*—George Harris
*Attorney, Agent, or Firm*—Bauer, Amer & King

[57] ABSTRACT

A switch which can be activated by a magnetic force and which includes a housing having at least two spaced apart electrical terminals thereon. Internal of the housing is contained a coil spring supported at one end thereof, and axially holding an elongated, magnetically responsive, conductive member in cantilevered fashion within the housing. The elongated member and spring can move from an aligned position to a deflected position responsive to the magnetic force. A first contact interconnects one of the electrical terminals with the supported end of the elongated member, by means of the coil spring. A second contact is interconnected to the other of the electrical terminals and contacts the cantilevered end of the elongated member in one of its two positions.

17 Claims, 15 Drawing Figures

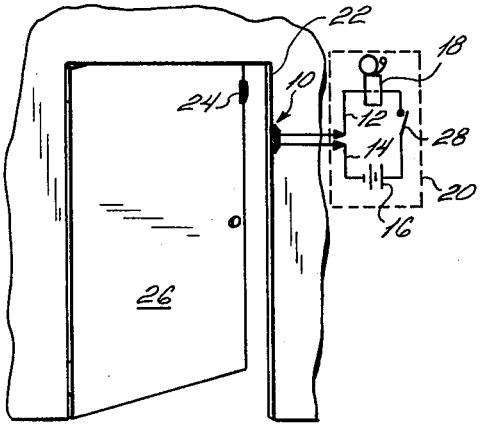
FIG. 1
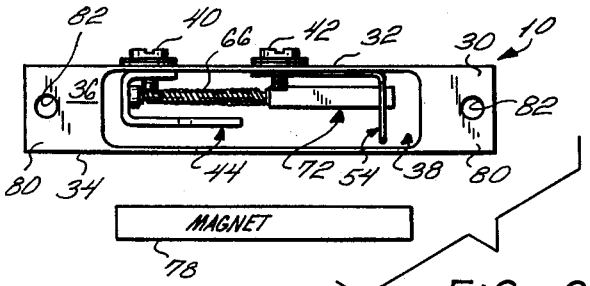
FIG. 2
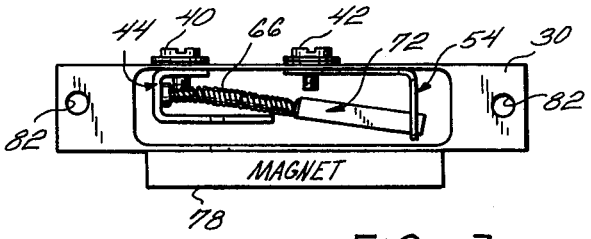
FIG. 3
FIG. 4
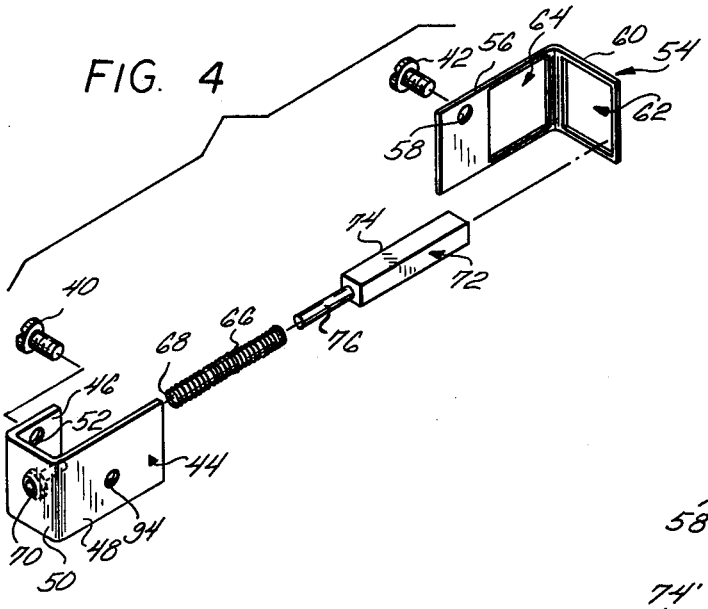
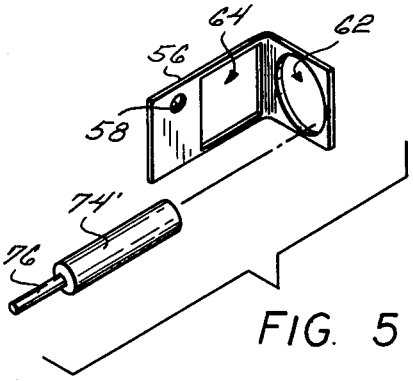
FIG. 5

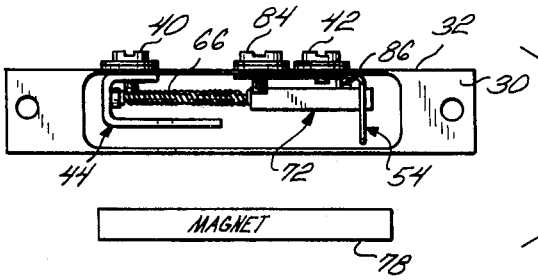
FIG. 7
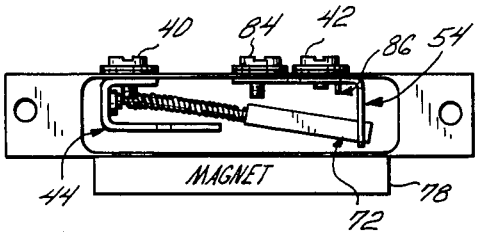
FIG. 8
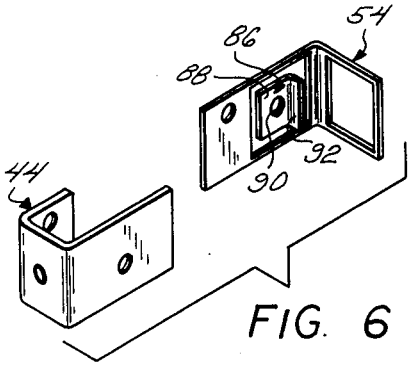
FIG. 6
FIG. 9
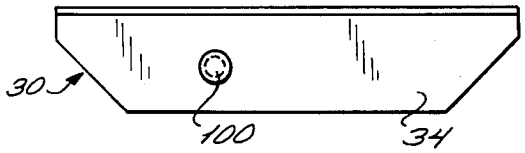
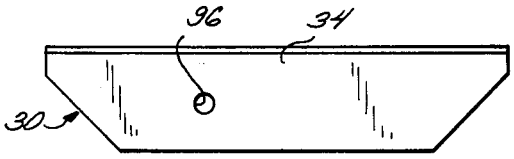
FIG. 10
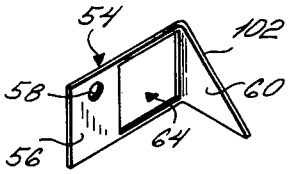
FIG. 12
FIG. 13
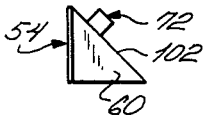
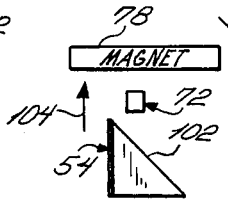
FIG. 14
FIG. 15
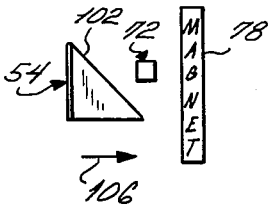
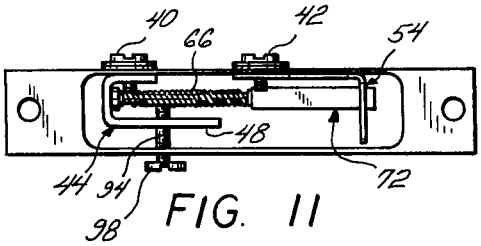
FIG. 11

MAGNETIC SWITCH

This invention relates to switches, and, more particularly, to a magnetically operated switch.

BACKGROUND OF THE INVENTION

Magnetic switches find widespread use, such as, for example, in burglar alarm systems where the actuating element for the switch does not directly come in contact with the switch. Typically, the switch is mounted on one fixed member such as a doorway or a window jamb, while the magnetic actuating element is fastened to a movable member such as the window, door or the like. The switch is interconnected to the burglar alarm system. When the window or door is moved, the switch contacts move from either a normally open or normally closed position to the opposite position, thus providing an actuating signal for the alarm system.

The prior art contains numerous types of magnetic switches which are typically held in plastic housings. Some of the prior art switches utilize reed contacts, while others utilize mechanical contacts. Unfortunately, these devices suffer from many disadvantages which detract from their performance, reliability and durability. For example, the reed switches can easily be defeated by using an additional magnet to hold the contact in a closed position. Utilizing the additional magnet, an unauthorized intruder can prevent the contact switches from moving while still opening the door, window, or the like. The mechanical contact switches suffer from failure after continued usage. Such prior art mechanical switches generally utilize leaf springs or flexed armatures. After continued usage, constant bending and flexure weakens the metal contacts and either produces complete device failure or unreliable performance.

In order to improve the performance of magnetic switches, complex arrangements have been incorporated to improve their reliability and durability. These complex arrangements include the use of bifurcated members having separate contacts and armatures which consecutively contact each other upon application of a magnetic force. Such complex arrangement is described in U.S. Pat. No. 3,676,811. Other types of magnetic switches control the flux pattern produced by permanent magnets, as described in U.S. Pat. No. 3,226,506 or U.S. Pat. No. 3,487,346. While these aforementioned devices may improve performance, they also increase the cost of manufacture and limit the extent of use of a particular device to unique situations. The switches described do not have the flexibility to be utilized in various types of situations and various types of burglar alarm systems.

SUMMARY OF THE INVENTION

It is, therefore, an object of the present invention is to provide a magnetic switch which has only one moving part which never reaches its stress point and, therefore, provides high reliability and excellent durability.

Still a further object of the present invention is to provide a magnetic switch which has the flexibility for permitting use in either normally open or normally closed burglar alarm systems.

Yet another object of the present invention is to provide a magnetic switch which can be used either as a mechanical magnet contact or a vibration contact.

Another object of the present invention is to provide a magnetic switch which can be utilized to make contact both in the normally open position as well as in the normally closed position.

Yet a further object of the present invention is to provide a magnetic switch which can be controlled by a magnetic force and wherein the magnet can be placed in any of a number of positions with respect to the magnetic switch.

Still a further object of the present invention is to provide a magnetic switch which is highly reliable, durable, has few parts, is simple in construction, and low cost in manufacture.

Yet another object of the present invention is to provide an improved burglar alarm system which includes a reliable, low cost magnetic switch with the flexibility to be utilized in various parts of a burglar alarm system.

These and other objects, features, and advantages of the invention will, in part, be pointed out with particularity, and will, in part, become obvious from the following description of the invention, taken in conjunction with the accompanying drawings, which form an integral part thereof.

Briefly, the invention describes a magnetic switch which can be activated by a magnetic force. The switch includes a housing containing at least two spaced apart electrical terminals thereon. A coil spring is supported at one end thereof within the housing. An elongated, magnetically responsive, conductive member is axially supported by the spring in cantilevered fashion within the housing. The elongated member and the coil spring are adapted to move from an aligned position to a deflected position responsive to a magnetic force. A first contact means interconnects the supported end of the elongated member with one of the terminals. A second contact means is interconnected to the other of the terminals and contacts the cantilevered end of the elongated member in one of its two positions.

In an embodiment of the invention, the coil is of a conductive material; the elongated member electrically contacts the coil, and the first contact means connects the terminal to the spring, whereby the supported end of the elongated member electrically contacts the first terminal through the coil spring. In another embodiment of the invention, the first contact means comprises a U-shaped member having one leg connected to said one terminal, the base contacting and supporting one end of the spring, and the other leg adapted to receive a contact screw which can be adjustably spaced adjacent to the coil spring. As the magnetic switch vibrates, the coil spring vibrates with respect to the contact screw thereby providing a vibration contact.

In another embodiment, the second contact means includes an L-shaped member, one leg of which is connected to the other electrical terminal and the second leg of which forms the contact with the elongated member. An aperture in the second leg receives the cantilevered end of the elongated member such that when in an aligned position the elongated member is spaced from the walls of the aperture and in a deflected position it contacts the aperture walls. A third terminal can also be provided on the housing and spaced adjacent to the elongated member such that the elongated member will contact the second terminal in one position and contact the third terminal in the other position.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

DESCRIPTION OF THE DRAWINGS

FIG. 1 is a schematic view of the magnetic switch shown positioned on a doorway and interconnected in a burglar alarm system;

FIG. 2 is a bottom view of the magnetic switch and an activating magnet in spaced relationship;

FIG. 3 is a view similar to FIG. 2 and showing the magnet as activating the switch;

FIG. 4 is an exploded view of the internal parts of the magnetic switch of the present invention;

FIG. 5 is an exploded view of an alternate embodiment of the elongated member and second contact means;

FIG. 6 shows an alternate embodiment of the first and second contact means;

FIGS. 7 and 8 show bottom views of the magnetic switch utilizing the contact means of FIG. 6, and respectively showing the deactivated and the activated positions;

FIGS. 9 and 10 show side views of the switch housing, and specifically showing the availability of a vibration contact control;

FIG. 11 shows a bottom view of the magnetic switch when used as a vibration contact;

FIG. 12 shows a further embodiment of the second contact means; and

FIGS. 13, 14 and 15 show the various positions of the elongated member when used in conjunction with the contact means shown in FIG. 12.

In the various figures of the drawing, like reference characters designate like parts.

DESCRIPTION OF THE PREFERRED EMBODIMENTS

Referring now to FIG. 1 there will be generally described how the magnetic switch of the present invention can be included within a burglar alarm system. The magnetic switch 10 includes at least two terminals which are interconnected to lines 12 and 14 and are coupled to a source of energy 16 and an alarm 18. The alarm and source are typically placed in a separate compartment 20 away from the member being protected. The magnetic switch 10 is typically shown as placed on the stationary part of a movable member as door jamb 22. A magnet 24 is placed on the movable part, in this case the door 26. A main switch 28 is included to energize the burglar alarm system. When the door is to be protected, the door 26 is closed so that the magnet 24 is adjacent to the switch 10 and activates it. The main switch 28 is then closed. In a normally open system, the magnet 24 will hold the contacts within the magnetic switch 10 in an open position as long as it is adjacent thereto. This will prevent current from the energy source 16 from activating the burglar alarm 18. Should an unauthorized user enter the premises and open the door, the magnet 24 will be moved away from the switch 10 permitting the contacts to close and thereby sounding the alarm. In a normally closed system, the circuit would be arranged such that when the door is closed, the magnet 24 holds the contacts of the switch 10 in a closed position. In such closed position, no current would pass to the alarm 18. However, when the manget 24 is moved away from the switch 10, the contacts will open thereby causing the alarm to sound. In such normally closed systems, the switch 10 would typically be placed in parallel with the alarm thereby shorting it out, or other arrangements could be formed, as is well known in the art.

Regardless of the type of system, a key element in the performance of a burglar alarm system is the operation of the magnetic switch. The switch must be reliable, and must be durable to continue operation over many years of continuous movement of the internal parts of the switch. Additionally, it should be of a type that cannot be defeated by using external additional magnets while the door is opened by an unauthorized intruder. Furthermore, it must be low cost, since many such contacts are placed on a premises, including doorways, windows and other members which can be opened. Also, while some windows cannot be opened, they can be broken into, and, therefore, in addition to mechanical contacts many burglar alarm systems utilize vibration contacts. With such vibration contacts, when the window is moved, as by means of an unauthorized intruder trying to break the window, the alarm will sound. In most prior art systems, separate constructions are required for a vibration contact and for a mechanical contact.

Referring now to FIGS. 2–4, there will be described the improved magnetic switch of the present invention. The switch 10 includes a housing 30 containing sidewalls 32 and 34 and a base member 36. A hollow portion 38 is formed in the housing to contain the internal elements. Electrical terminals 40 and 42 are placed on the housing and are shown as screws which extend through the wall 32 and into the hollow portion 38. A first contact means 44 interconnects to the terminal 40. The first contact means 44 is shown as a U-shaped member having a first leg 46 shorter than its other leg 48 and including a base portion 50 interconnecting the two legs. The shorter leg 46 includes a screw hole 52 which receives the terminal contact screw 40 and makes electrical contact thereto. The screw 40 also serves to structurally maintain the contact means 44 in secure relationship to the housing 30.

A second contact means 54 is shown as an L-shaped member having a first leg 56 containing a screw hole 58 which receives the terminal contact screw 42 for both electricalcontact thereto and structural support onto the housing 30. The other leg 60 of the L-shaped member contains an aperture 62. The first leg 56 also contains a substantial portion thereof cut out, as shown at 64.

A coil spring 66 has one end thereof 68 supported within the housing. The support is shown by means of a rivet stud 70 inserted in the base 50 of the U-shaped contact means 44. The coil spring is force fit over the stud. Other support means could also be utilized, as is well known in the art. The coil spring in turn supports an elongated member 72 formed of conductive material which is magnetically responsive to a magnetic force. The elongated member includes a post portion 74 and a stem portion 76. The stem is adapted to snugly fit within the coil spring 66 so that it is supported in cantilevered fashion within the housing.

When the magnet 78 is spaced from the switch (FIG. 2) such that its force does not act upon the switch, the coil spring 66 will lie in an axial position and maintain the elongated member 72 aligned therewith. The cantilevered end of the elongated member 72 will extend through the aperture 62 in the L-shaped contact 54 and will not touch the walls of the aperture so that no contact will occur between the elongated member 72 and the second contact means 54. When the magnet 78 is brought adjacent to the switch (FIG. 3) the magnetic force will act upon the magnetically responsive elongated member 72 and will attract it thereby deflecting the position of the coil springs 66 and making the elongated member 72 contact the walls of the aperture 62 of the first contact means 54. This contacting will complete a circuit between the terminals 40 and 42 permitting current to pass through a circuit including the terminal 40, the first contact means 44, the stud 70, the coil spring 66 and the elongated member 72. In its deflected position the elongated member contacts the terminal 54 which is connected to the terminal 42. When the magnet 78 is moved away from the switch, the coil spring 66 will force the elongated member 72 back into its aligned position which will separate the elongated member from the second contact means 54 thereby disconnecting the flow of current.

Although movement will occur within the magnetic switch, the movement does not flex any stiff member nor does it bend any armature. Rather, the movement occurs as a result of the deflection of a coil spring. As a result, no parts reach their stress points and thereby the possibility of failure of the mechanical parts is avoided.

The rod portion 74 of the elongated member 72 is shown in FIG. 4 as having a substantially square cross-sectional area. Similarly, the aperture 62 is shown as a corresponding square shape. However, it is understood that other shapes could be utilized, as shown by way of example in FIG. 5 where the rod portion 74 is shown as being of substantially round shape and the aperture 62 is shown also as being of substantially round shape. The housing 30 contains tab portions 80 which include apertures 82 for mounting the magnetic switch onto a surface such as a window or door jamb.

It is to be noted that the screw holes 52 and 58 in the respective first and second contact means are offset with respect to the plane of movement of the spring 66 and elongated member 72. Namely, the elongated member 72 will move along a plane from rear to front, as shown in FIG. 4. The screw holes 52 and 58 are, therefore, placed upward of this plane of movement so as not to interfere therewith should the screws extend too far into the housing.

Referring now to FIGS. 6–8 there will be shown a further embodiment of the present invention and specifically including a third contact terminal 84 positioned on the wall 32 of the housing 30 in between the terminals 40 and 42. The three terminals are, of course, spaced apart from each other and not interconnected. The third electrical terminal 84 connects to a third contact means 86 which includes an L-shaped member having one leg 88 containing a screw hole 90 which accommodates an adjustable terminal screw 84. A second leg 92 extends inwardly of the housing and is placed to contact the elongated member 72 when in its aligned position as shown in FIG. 7.

With this embodiment, when the magnet 78 is spaced from the switch (FIG. 7), the spring 66 and supported elongated member 72 will be in its aligned position wherein it is spaced from the second contact means 54 but touches the third contact means 86. When the magnet 78 is brought adjacent to the switch (FIG. 8), the elongated member 72 is deflected to contact the second contact means 54 while it is spaced from the third contact means 86.

Using the embodiment shown in FIGS. 6–8 the switch can be utilized in a circuit requiring contact in both a normally open and normally closed positions. When the door or window is closed and the magnet is adjacent to the switch, contact will be made between terminal 40 and terminal 42. When the door or window is opened and the magnet is removed from the switch, contact will be made betwen terminal 40 and terminal 84.

Referring to FIGS. 9–11, there will be described how the magnetic switch of the present invention can also be utilized as a vibration contact. It will be noted that the first contact means 44 includes a third leg 48 which also contains a screw hole 94 (FIG. 4). This screw hole is placed directly in the plane of movement of the coil spring 66. A screw hole 96 (FIG. 10) is coaxially positioned in the wall 34 of the housing 30 such that a biasing screw 98 can be inserted through the housing 96 which will pass through the screw hole 94 of the leg 44 adjacent to the coil spring 66. The screw 98 can be adjusted to either bias the coil spring in its aligned position to thereby touch the fixed contact means 54, or to be slightly spaced therefrom. The screw can be used to provide detection of vibration of the magnetic switch. For example, the switch of FIG. 11 can be placed on a window without the need of any magnet adjacent thereto. Should the window begin vibrating, as for example, when an unauthorized intruder tries to break it, the switch will vibrate causing the coil spring 66 and elongated member 72 to vibrate in its plane of movement. As it vibrates, it will come in contact with the fixed contact means 54 and thereby close the circuit between terminal 40 and terminal 42.

By spacing the screw 98 from the spring 66 contact will only be made as the coil spring vibrates. On the other hand, the screw 98 can bias the spring 66 so that contact is maintained with contact means 54 and will only be broken as the switch vibrates. It is, therefore, apparent that the magnetic switch heretofore described cn be used either to provide magnetic contact or vibration contact. A removable plastic plug 100 can initially be inserted into the screw hole 96. If the switch is being utilized as a magnetic contact, the plug 100 will remain in the wall. Should the switch be used as a vibration contact, the plug 10 is snapped out and the contact screw 98 is inserted.

In the embodiments heretofore described, the elongated member 72 will not make contact with the second contact means 54 when in its aligned position, but will make contact in its deflected position. Referring now to FIGS. 12–15, it will be noted that the second contact means 54, can be modified, and specifically the second leg 60 can be made of a triangular shape having a diagonally cut top portion 102. In this case, there need not appear any aperture in the leg 60. The elongated member 72 will, therefore, normally rest upon the edge 102 in its aligned position and make contact with the second contact means 54 in that position (FIG. 13). The magnet will then break contact by moving the member 72 to its deflected position.

Utilizing this embodiment, it is possible to place the magnet in various positions. For example, the magnet 78 can be placed adjacent one wall of the magnetic switch, as shown in FIG. 14, whereby in its deflected position, the elongated member 72 will move in the direction shown by the arrow 104 away from the face 102 of the second contact means 54. Additionally, the magnet 78 can be placed adjacent the open end of the switch (FIG. 15) in which case the elongated member 72 will move in the direction shown by the arrow 106 away from the face 102 of the second contact means 54.

The various conductive members, such as the screws, contact means, springs and elongated member, can be made of conductive material, such as steel or the like. The housing should be made of insulating material, such as plastic or the like. The electrical terminals could be separated from each other by means of sections molded directly from the housing and extending between the various terminals.

It will be appreciated, that the heretofore described magnetic switch is a versatile switch which finds numerous uses within typical burglar alarm situations and can be used both as a magnetic switch and as a vibration contact. It provides easy installation for both normally open and normally closed systems as well as systems requiring both such connections.

There has been disclosed heretofore the best embodiment of the invention presently contemplated. However, it is to be understood that various changes and modifications may be made thereto without departing from the spirit of the invention. It is the intention, therefore, to be limited only as indicated by the scope of the claims appended hereto.

What is claimed is:

1. A switch activated by a magnetic force comprising: a housing; at least two spaced apart electrical terminals; on said housing; an electrically conductive coil spring supported at one end thereof within said housing; an elongated, magnetically responsive, conductive member axially supported by said spring in a cantilevered fashion within said housing, said elongated member and said spring being adapted to move from aligned to deflected positions responsive to a magnetic force; first contact means interconnecting the supported end of said spring with one of said terminals, and second contact means interconnected to the other of said terminals encircling said conductive member and contacting said conductive member in one of said aligned and deflected positions.

2. A switch activated by a magnetic force, comprising: a housing; at least two spaced apart electrical terminals on said housing; an electrically conductive coil spring supported at one end thereof within said housing; an elongated, magnetically responsive, conductive member axially supported by said spring in a cantilevered fashion within said housing, said elongated member and said spring being adapted to move from aligned to deflected positions responsive to a magnetic force; first contact means interconnecting the supported end of said spring with one of said terminals, and second contact means interconnected to the other of said terminals encircling said conductive member and contacting said conductive member in one of said positions, and wherein said first contact means comprises a U-shaped member, one leg of which is connected to said one terminal and the base of which contacts and supports one end of said spring.

3. A switch as in claim 2 and wherein said electrical terminals include conductive screws extending through a wall of said housing, and wherein said one leg includes a screw hole receiving the screw of said one terminal, said screw hole being transversely offset from the plane of movement of said coil spring to thereby prevent interference with such movement.

4. A switch as in claim 2 and further comprising fastening means in the base of said U-shaped member for securely retaining said one end of said spring.

5. A switch as in claim 4 and wherein said fastening means comprises a rivet stud, and wherein said one end of said spring is force fit onto said rivet stud.

6. A switch as in claim 2 and wherein said other leg of said U-shaped member includes a screw hole adapted to adjustably receive a biasing screw extending inwardly from a facing wall of said housing, said screw hole lying in the plane of movement of said spring, whereby vibration of said contact switch causes the portion of said coil spring supporting said conductive member to vibrate with respect to said biasing screw, the bias applied by the biasing screw to the spring being adjustable.

7. A switch as in claim 6 and wherein said facing wall of said housing includes an access hole aligned with the screw hole in said other leg of said U-shaped member, and further comprising a knock-out piece, which plugs up the access hole in said facing wall.

8. A switch as in claim 1 and wherein said second contact means includes an L-shaped member, one leg of which is connected to said other terminal, and the other leg of which contacts said elongated member.

9. A switch as in claim 8 and wherein said electrical terminals include conductive screws extending through a wall of said housing, and wherein said one leg includes a screw hole adapted to receive a screw of said other terminal, said screw hole being transversely offset from the plane of movement of said elongated member to thereby prevent interference with said movement.

10. A switch as in claim 8 and wherein said other leg includes an aperture for receiving the cantilevered end of said elongated member, said elongated member positioned to be spaced from the walls of said aperture when in an aligned position and contacting the walls of said aperture when in a deflected position.

11. A switch as in claim 10 and wherein said elongated member includes a rod portion and a stem portion, said stem portion being securely positioned within said spring and said rod portion extending into said aperture.

12. A switch as in claim 11 and wherein said rod portion has a substantially square cross-sectional area, and wherein said aperture is a substantially square hole.

13. A switch as in claim 11 and wherein said rod portion has a substantially round cross-sectional area, and wherein said aperture is a substantially round hole.

14. A switch as in claim 10 and further comprising a third electrical terminal on said housing, and a third contact means, said third contact means comprising an L-shaped member having one leg thereof positioned in the cut out portion of said second contact means to prevent contact therewith, said last mentioned one leg being interconnected to said third electrical terminal and the other leg of said third contact means projecting into said housing to reach said elongated member in its aligned position, whereby said first terminal is interconnected to said third terminal in one position and to said second terminal in the other position.

15. A switch as in claim 8 and wherein said other leg is of a triangular shape, said elongated member resting on the diagonal of said triangular shape when in an aligned position and being free to move in at least two mutually perpendicular transverse planes away from said diagonal when being deflected by a magnetic force.

16. A burglar alarm, comprising: a source of energy; an alarm means; and a magnetic switch interconnecting said source and said alarm means, wherein said magnetic switch further comprises; a housing; at least two spaced apart electrical terminals on said housing; a coil spring supported at one end thereof within said housing; an elongated, magnetically responsive, conductive member axially supported by said spring in a cantilevered fashion within said housing, said elongated member and coil spring being adapted to move from an aligned position to a deflected position responsive to a magnetic force; a first contact means interconnectig the supported end of said elongated member with one of said terminals, and second contact means interconnected to the other of said terminals encircling said conductive member and contacting the cantilevered end of said elongated member in one of said positions.

17. A burglar alarm as in claim 16 and further comprising magnetic means capable of being positioned adjacent to said magnetic switch and providing said magnetic force.

* * * * *